US009316469B2

(12) United States Patent
Parker et al.

(10) Patent No.: US 9,316,469 B2
(45) Date of Patent: Apr. 19, 2016

(54) ELECTRONIC TRACKING SYSTEM

(71) Applicant: Insights International Holdings, LLC, Newsoms, VA (US)

(72) Inventors: Evan Parker, Newsoms, VA (US); Daniel W. Loyer, San Clemente, CA (US); William Shucart, Healdsburg, CA (US)

(73) Assignee: Insights International Holdings, LLC, Newsoms, VA (US)

( * ) Notice: Subject to any disclaimer, the term of this patent is extended or adjusted under 35 U.S.C. 154(b) by 438 days.

(21) Appl. No.: 13/898,691

(22) Filed: May 21, 2013

(65) Prior Publication Data

US 2013/0257656 A1 Oct. 3, 2013

Related U.S. Application Data

(63) Continuation-in-part of application No. 13/106,255, filed on May 12, 2011, now Pat. No. 8,446,319.

(60) Provisional application No. 61/334,869, filed on May 14, 2010, provisional application No. 61/816,455, filed on Apr. 26, 2013.

(51) Int. Cl.

| | |
|---|---|
| ***G01S 1/00*** | (2006.01) |
| ***F42B 12/38*** | (2006.01) |
| ***F42B 12/36*** | (2006.01) |
| *F41B 11/00* | (2013.01) |

(52) U.S. Cl.

CPC ..... *F42B 12/385* (2013.01); *F42B 12/365* (2013.01); *F42B 12/382* (2013.01); *F41B 11/00* (2013.01)

(58) Field of Classification Search

CPC ..... G01S 1/00; G01S 1/08; F42B 12/385; F42B 12/365; F42B 12/382; F41B 11/00

USPC ..... 342/385; 473/570, 578

See application file for complete search history.

(56) References Cited

U.S. PATENT DOCUMENTS

| | | | | |
|---|---|---|---|---|
| 4,940,245 | A * | 7/1990 | Bittle, Jr. | A01M 31/00 342/386 |
| 4,976,442 | A | 12/1990 | Treadway | |
| 5,094,463 | A * | 3/1992 | Dryden | F42B 12/385 342/386 |
| 5,856,631 | A * | 1/1999 | Julien | F41A 21/20 42/76.02 |
| 6,115,636 | A | 9/2000 | Ryan | |
| 6,311,623 | B1 * | 11/2001 | Zaruba | F42B 6/04 102/371 |
| 7,300,367 | B1 * | 11/2007 | Andol | F42B 12/385 342/385 |
| 7,426,888 | B2 | 9/2008 | Hunt | |
| 8,075,430 | B1 * | 12/2011 | Hester | F42B 12/385 473/578 |
| 2002/0010390 | A1 | 1/2002 | Guice | |
| 2003/0229383 | A1 | 12/2003 | Whitehurst et al. | |

(Continued)

*Primary Examiner* — Harry Liu
(74) *Attorney, Agent, or Firm* — Fish & Tsang, LLP

(57) ABSTRACT

An electronic tracking system for obtaining geographic or other information about a targeted object from deployed ordnance. Ordnance can be delivered from any suitable weapon or weapons system, including hand-held or artillery guns, manned or unmanned aircraft, etc. The ordnance can be substantially any projectile targeted at a human, animal or other object. Once deployed, the ordnance can provide a variety of information about location, the target, the shooter, or the ordnance itself. Such information can be transmitted at any suitable interval, even time-delayed or upon a condition. Preferably, the system also contains a receiver to receive the transmitted information. Once received, the information can be then provided to users in any appropriate fashion.

16 Claims, 6 Drawing Sheets

(56) References Cited

U.S. PATENT DOCUMENTS

2006/0142820 A1 6/2006 Von Arx et al.
2006/0213105 A1* 9/2006 Cugliari ..... F42B 12/36
42/1.01
2010/0117906 A1 5/2010 Miller et al.
2011/0057042 A1 3/2011 Duggan et al.
2011/0148884 A1 6/2011 Zeleny

* cited by examiner

ELECTRONIC TRACKING SYSTEM

This application claims priority to utility patent application Ser. No. 13/106,255 filed May 12, 2011, which claims priority to provisional patent application Ser. No. 61/334,869 filed May 14, 2010, and also claims priority to provisional patent application Ser. No. 61/816,455 filed Apr. 26, 2013, the disclosures of which are all incorporated herein in their entireties.

FIELD OF THE INVENTION

The field of the invention is electronic tracking systems.

BACKGROUND

The background description includes information that can be useful in understanding the present invention. It is not an admission that any of the information provided herein is prior art or relevant to the presently claimed invention, or that any publication specifically or implicitly referenced is prior art.

There are several instances in which it is useful to track a targeted object. For example, in hunting with an arrow, a harpoon, a spear, or crossbow bolt, a targeted animal that is only wounded might well escape into a wooded, rocky, subterranean, or otherwise difficult terrain, or dive deep into a lake or ocean where it might be difficult or impossible to find. Tracking the target can allow the target, whether dead or alive to be secured in a timely fashion.

Except where the context indicates otherwise, the term "animal" should be interpreted herein as including a human being, and the term "target" should be interpreted to include both human and non-human targets. In the case of a military or police operation, it can very useful to track a targeted individual, to confirm death, or perhaps to lead personnel to a hideout. There are also numerous instances in which it would be useful to target an automobile, truck or other vehicle, and perhaps track that vehicle back to an enemy base.

Tracking Human Or Other Animals

In the case of targeting, and then tracking animals or humans, issues arise from using a relatively low power transmitter. If the antenna is external to the target, the antenna can often be rubbed off on a tree, rendered non-functional by the target falling down on top of the antenna, or by other movements of the target. Such problems attend embodiments of U.S. Pat. No 7,300,367 to Andol et al., for example, which teaches a tracking assembly having hooked barbs that enter the hide/skin of the target, leaving a transmission module attached to the outside of the target.

If the antenna is internal to the target, then the signal is often so attenuated by the body that the signal is too weak to track. One cannot merely increase the signal power because (a) the drain on the battery or other power source would likely be too great, and (b) the degree of signal attenuation would vary so much depending upon placement of the shot, that some shot placements would result in a tissue-damaging signal, while others would result in almost no externally relevant signal at all. Such problems attend embodiments of U.S. patent application Ser. No. 4,976,442 to Treadway et al., which teaches an arrow shaft mounted transmission module that is released from the shaft as the shaft enters the target. Similar problems attend shots placed with a bullet rather than a shafted ordnance, both against hunted animals and in military or police operations where the ordnance is used against a human. As used herein, the term "animal" should be read to include a human.

Andol and Treadway, as well as any other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

It is known in some instances to place an antenna inside a body for diagnostic purposes. Such implanted modules use a low power data transmission to an external monitoring device typically using the Medical Implant Communication Service (MICS) bands (401 MHz to 406 MHZ) or the Wireless Medical Telemetry bands (608 MHz to 614 MHz, 1395 MHz to 1400 MHz and 1427 MHz to 1432 MHz). Other frequencies commonly used are the 915 MHz and 2.45 GHz bands in the Industrial, Scientific and Medical Equipment (ISM) bands. It turns out, however, that such frequencies are not suitable for tracking living beings because the transmissions are attenuated much too quickly in the body and over long distances at the low power needed to meet regulatory requirements.

The main reason for using a higher frequency is that the size of the antenna is smaller than for a lower frequency, since the length of the antenna is dependent on the wavelength of the RF signal. In general terms, the frequency of an RF signal increases as the wavelength of that RF signal decreases.

More specifically, the wavelength of an RF signal is dependent on the frequency and the dielectric constant of the material through which the signal is travelling. Since the dielectric constant of dry air is relatively constant over frequencies up to 100 GHz, the wavelength of an RF signal in dry air is also relatively constant and easy to calculate. In contrast, the various tissues in a body each have different dielectric constants that are frequency dependent, so the wavelength of an RF signal travelling through a body varies with the different tissues it passes through and with the frequency of the signal, thus calculating the wavelength of an RF signal in a body requires knowing the dielectric constants of the various body tissues at the frequency of the RF signal and is usually reduced to an approximation using a composite equivalent dielectric constant for a typical body.

Another aspect of the frequency dependency of the dielectric constants of various body tissues is that the absorption of an RF signal by the body increases with frequency. For frequencies under about 4 MHz, the wavelength of the signal is significantly larger than the cross-section of a typical human body and there is very little effect on the signal. Above 4 MHz, the absorption of signal energy increases in proportion to the increase in frequency until the human body becomes essentially opaque to RF signals. And above about 1 GHz, the different dielectric properties of the various body tissues begin to cause diffraction and refraction of the RF signal at the tissue boundaries.

The frequency dependency of the dielectric constants of various body tissues also affects the efficiency of implanted antennas for medical applications, which typically only achieve an efficiency of 0.01% to 3% as compared to antennas out in the open air that can usually achieve 95% efficiency.

The higher the frequency, the higher the absorption by the body and the resulting loss of RF signal strength as it passes through a body. As a result, it is desirable to keep the frequency of transmissions for a tracking device as low as practical to reduce the attenuation of the RF signal by the body to which the tracking module is attached. The lower limit for a practical frequency is determined by the length of the antenna needed.

Since the conductivity differential between blood and other body tissues is typically at least 5:1, coupling an RF signal to the blood in the circulatory system, using a matching network to maximize signal transfer, will essentially use the blood as the conductor of a large area, lossy fractal antenna. The effective length of a circulatory system antenna would be dependent on the placement of the wireless device in the body relative to the extremities, but would be several orders of magnitude longer than any antenna that could be contained in (or on) the wireless device.

And while the transmission losses would be rather high, depending on the RF signal frequency and the dielectric constants of the surrounding tissues, the overall RF transmission efficiency should be at least as good as for antennas currently in use with implanted wireless devices.

Thus, there is still a need for ordnance usable against a human or other animal, which provides a good tracking signal, preferably where the antenna is internal to the body.

Military or Policing Operations

Additional issues arise in military or policing operations, where there can be a large number of shots fired, possibly in a very short period of time, and where there is a need for command and control to obtain near real time visibility of the operation.

For example, there might be a need to begin transmission of a tracking signal only upon occurrence of a desired condition, such as a bullet entering a body. That way thousands of rounds could be fired, but only the dozen or so that actually hit a person would continue sending tracking signals. Having a smaller number of tracking signals could aid command and control in quickly assessing the situation.

Other special situations arise in military or policing operations, where it can be desirable to provide a tracking signal over many hours, or even days. That can be extremely difficult to accomplish where all of the electronics and power are severely constrained by the size of the bullet or other ordnance. Thus, there is a need to provide electronics that might preclude some or all of the transmission until several minutes or even hours after deployment, or to provide at least some of the power from a chemical interaction with the target. Another potential need to provide some sort of local area network that could relay weak theatre-based signals, via satellite or otherwise, to a more distant command and control center. There can also be special needs regarding field deployment of the network, as for example by a portable relay that could be fired at an opposing position.

Still other special situations arise in military or policing operations, where one might want to use non-lethal ordnance, such as a color marker or a dart.

SUMMARY OF THE INVENTION

The inventive subject matter provides apparatus, systems and methods in which tracking or other information is provided from a deployed ordnance.

Ordnance can be all suitable carriers contemplated, including for example an arrow, a harpoon, a spear, a tranquilizer dart, a crossbow bolt, bullets from a gun, grenades, darts, gas cartridges, and so forth. Ordnance can be solid, hollow, frangible or otherwise. Ordnance can be exploding or non-exploding.

Ordnance information can provide any ordnance-relevant, practical information. One or more relays can send the information to any one or more of a local monitor, a local and a distant command. The module preferably includes a circuit that provides location information to the transmitter, and optionally provides additional information.

The inventive subject matter provides an apparatus, systems and methods in which an ordnance has a tracking module with one or more transmitters. Transmission(s) can occur at any suitable interval.

Preferred systems include a receiver for receiving information from the transmitter. The received information can be provided to a user in any suitable manner, including for example, visually using a display screen and/or blinking light, or auditorily using a speaker or other sound producing component.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
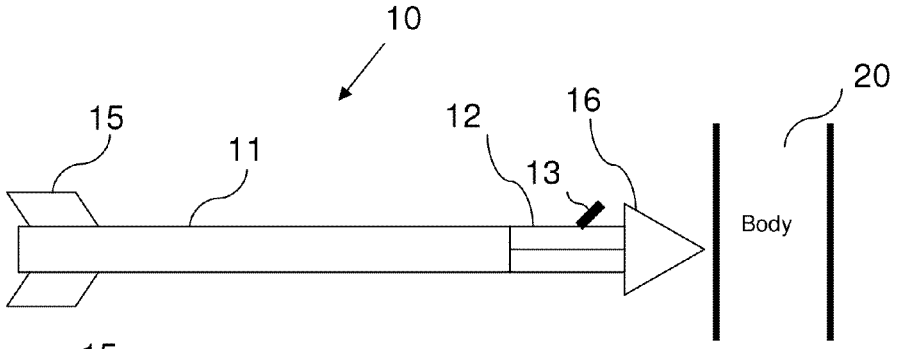
FIG. 1 is a schematic drawing of an ordnance having a tracking module, where the ordnance is about to enter a body of a target.

Various objects, features, aspects and advantages of the inventive subject matter will become more apparent from the following detailed description of preferred embodiments. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, the term "pneumatically propelled" means that the projectile is propelled from the weapon using an expanding gas. Examples of pneumatically propelled projectiles include ordinary bullets, where the expanding gas is produced by rapid oxidation of gunpowder. Other propulsion means are also contemplated, however, including for example, electromagnetically propelled ordnance.

The term "munition(s)" is used herein to include both ordnance and weapons used to fire ordnance. The term "ordnance" is used in the plural or singular, depending upon context.

In preferred embodiments, the ordnance includes a carrier and a tracking module. All suitable carriers are contemplated, including for example the shaft of an arrow, a spear, or a harpoon or a tranquilizer dart, bullets, grenades, darts, gas cartridges, aerial drones and so forth. All suitable tracking modules are also contemplated, provided they have a suitable size, shape and composition to be transported to the target by the carrier. Ordnance can be solid, hollow, frangible or otherwise. Ordnance can be exploding or non-exploding. Ordnance can be fired from an existing weapon, from a custom designed weapon, or it might be thrown, and therefore not be fired from a weapon at all. As used herein the term "ordnance" excludes manned and unmanned aircraft from which other ordnance is deployed.

In an especially preferred class of embodiments, tracked ordnance can be deployed from a manned or unmanned aircraft (UAV), a miniature UAV, from a missile, from a tank, personnel carrier or ground vehicle, or any other suitable vehicle.

As discussed above, the ordnance can comprise an arrow, a harpoon, a spear, and a crossbow bolt or other elongated shaft, where the carrier is the shaft and the module is carried by the shaft. For shafted weapons, it is advantageous to provide a release mechanism that releases the module from the shaft after at least a portion of the shaft has entered the body. Suitable release mechanisms include a simple hook such as that found on U.S. Pat. No. 4,976,442 discussed above, or a pressure fit mechanism. It is also contemplated that the release mechanism could be chemical, such as where the module is coupled to the carrier using an adhesive.

The module is releasable from the carrier. The ordnance can advantageously include a release mechanism that releases the module from the carrier when the module is disposed within the body of the target. The module can be coupled to the carrier using an adhesive, a hook, a pressure fit mechanism, or any other suitable means. Where the carrier comprises a bullet casing, the module can advantageously compose the bullet, and the casing only carries the bullet until the bullet is fired from a gun. In such embodiments, the bullet performs functions similar to an arrow or other carrier.

Figure 2:
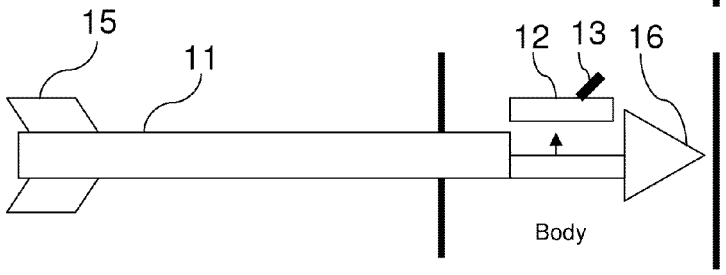
FIG. 2 is a schematic drawing of the ordnance of FIG. 1, in which the pointed end of the ordnance has entered the body, and the tracking module has been pulled away from the shaft.

The particular embodiment in FIG. 2 uses a hook 13 as a release mechanism, which is engaged by the body to release the tracking module 12. In this usage, the hook should be considered generically to refer to any barb, lever or other appendage that sticks out from the carrier, and that is used to cause the release of the tracking module from the carrier as they enter the body.

It is still further contemplated that the tracking module could include an interrogation receiving circuit. That would allow a user to transmit an instruction to the tracking module, preferably from an associated monitoring device. Contemplated instructions include: (1) stopping, slowing, or in some other manner altering transmissions from the tracking module, either permanently or for some period of time; (2) altering the type of information being transmitted; and (3) releasing an electrical signal or a chemical into the body of the target to paralyze, kill or otherwise affect the target.

Figure 3:
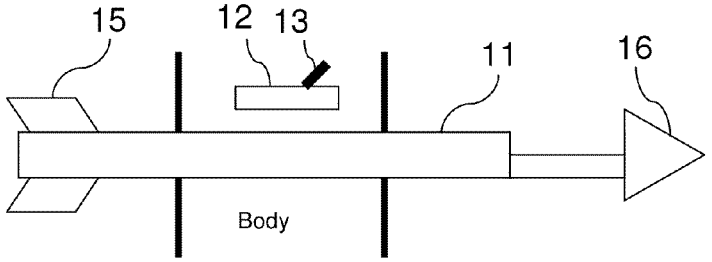
FIG. 3 is a schematic drawing of the ordnance of FIGS. 1 and 2, in which the shaft of the ordnance continues to pass into or through the body, and the tracking module remains in position within the body.

In FIGS. 1-3, a shafted ordnance 10, which should be generically considered to be any of an arrow, a spear, a harpoon, a tranquilizer dart, and a crossbow bolt, has a carrier 11 and a tracking module 12, and guides 15 and pointed head 16. FIGS. 1, 2, and 3 should be viewed as temporally successive snapshots of the ordnance about to enter the body, partially within the body, and then passing through the body.

In FIG. 3, the carrier 11 is passing through the body. It should be apparent to those skilled in the art, however, that the carrier might not completely exit the body, as where the body portion entered is too thick, or the momentum of the carrier is too low, or the carrier strikes a hard object such as a bone.

Figure 4:
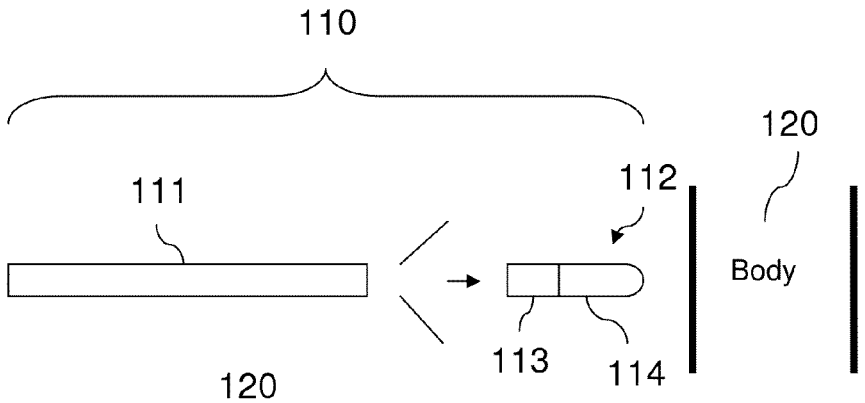
FIG. 4 is a schematic drawing of a bullet type of ordnance, the ordnance having a tracking module, and where the ordnance is about to enter a body of a target.
Figure 5:
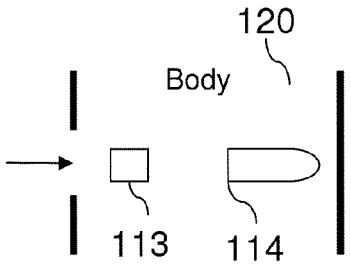
FIG. 5 is a schematic drawing of the ordnance of FIG. 4, in which the pointed component of the ordnance has entered the body, and the tracking module has been pulled away from the pointed component.
Figure 6:
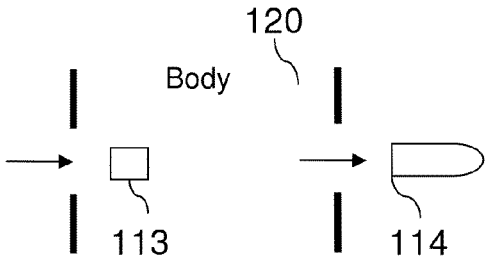
FIG. 6 is a schematic drawing of the ordnance of FIGS. 4 and 5, in which the pointed component of the ordnance continues to pass into or through the body, and the tracking module remains in position within the body.

In FIGS. 4-6, an ordnance 110 has a casing 111 and a bullet 112, which comprises a tracking module 113 and a pointed component 114. The bullet 112 (including the module 113) is released from the casing 111 upon firing. The bullet 112 enters the body 120, but of course in most instances the casing remains outside the body. Bodies 20 and 120 can be a body cavity or other portion of the body. Here again, the three figures represent successive snapshots of the ordnance about to enter the body, partially within the body, and then passing through the body. Although not shown in the figures, it is also contemplated that a bullet type of ordnance can either exit the body, or remain within the body. Additionally, the bullet, which could include the tracking module, could be slowed within the body by a flattening effect of the pointed component, and the pointed component might not exit the body.

Figure 7:
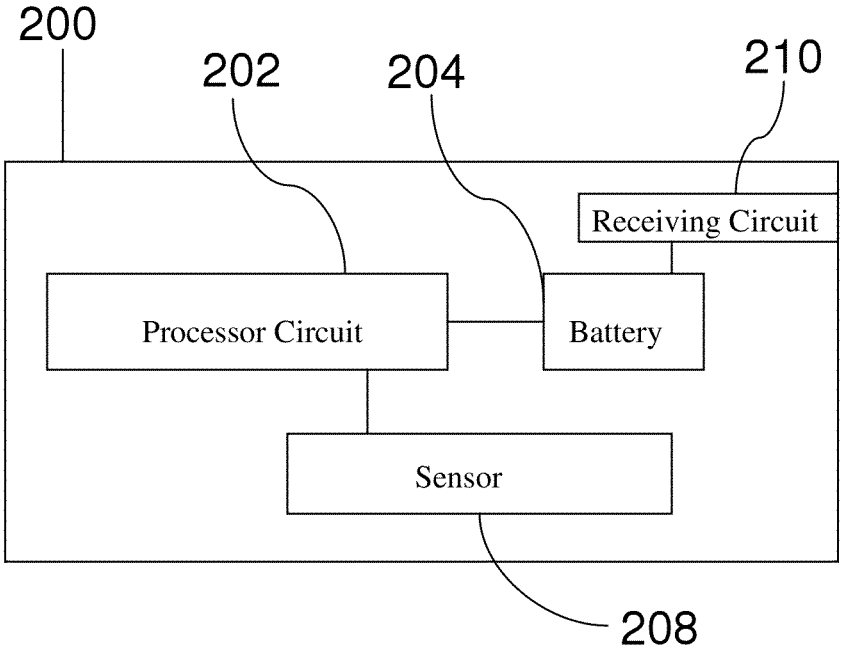
FIG. 7 is a schematic of a tracking system that includes a tracking module with transmission, processor circuit and battery, an optional sensor and an optional receiving circuit.

FIG. 7 shows a system that includes: (1) a generic tracking module 200, which can correspond to component 12 in FIGS. 1-3 and component 113 in FIGS. 4-6; and (2) a tracking module 200 that includes a transmission and processor circuit 202 and a battery 204. In this particular embodiment tracking module 200 also includes an optional sensor 208 and an optional receiving circuit 210.

The inventive subject matter provides apparatus, systems and methods in which an ordnance has a tracking module with a transmitter that electronically transmits information regarding the geographic location following impact. Signal transmission can occur at any suitable interval(s) and duty cycle. The transmitter preferably transmits the location information at least three times during a ten minute period, more preferably at least five times during a ten minute period, most preferably at least ten times during a ten minute period. From another perspective, location signals are preferably transmitted over a period of at least two hours, more preferably at least five hours, still more preferably at least ten hours, and most preferably at least 24 hours. It is contemplated that signals could be transmitted at differing duty cycles. For example, a device could transmit every minute for the first hour, then every five minutes for the next two hours, and then every 10 minutes thereafter. In some contemplated embodiments the transmitter can transmit a no heart beat signal, failure signal, low battery signal, and so forth.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In addition, the recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

In addition to providing location and physiologic information, it is contemplated that the transmitter could transmit other information, for example one or more of speed and compass (i.e., how fast the tagged object is moving and/or in what direction). Other contemplated sensors can include an accelerometer and/or a microphone.

Tracking modules can advantageously include circuitry that adds identification information to the signal, or use some other feature to distinguish modules, such that two, ten, a hundred, and even a thousand or more different tracking modules could be used in the same locale without confusing which target is which on the user's monitoring device. Other contemplated features include use of different frequencies, or other signal characteristics.

Preferred systems include a receiver for receiving information from the transmitter. The received information can be provided to a user in any suitable manner, including for example, visually using a display screen and/or blinking light, or auditorily using a speaker or other sound producing component. In particularly preferred embodiments, the receiver could advantageously use a flashing indicator to show when the heart beats, and/or a numeric display to show the number of heart beats per minute. It is further contemplated that the receiver could include a GPS (Global Satellite Positioning) chip, which could be used. for example, to assist someone carrying or wearing the receiver, as well as others in some circumstances, in locating the tracked device. Receivers could be specially designed or adapted equipment, or could even be a general-purpose cell phone, pda or other hand-held or vehicle-mounted device running an appropriate application to accomplish the functions described for the receiver herein. It is still further contemplated that using the GPS, the display could show the path taken by a target superimposed on a topographical display.

One possible use is for tracking ordnance delivered to a target is use of the beacon or coordinates provided by the tracked ordnance to deliver an airstrike, artillery or other offensive action.

From a method perspective, the inventive subject matter includes the steps of shooting a tracking module into a target animal, where the tracking module has a sensor and a transmitter that can use at least a portion of the target's body as an antenna to transmit a signal containing position information and information derived from a sensor. Most preferably the tracking module makes use of the blood system of a target as an antenna, using lower frequencies than would otherwise be practical with other types of antennas. In that way one can overcome the issues noted with previous methods of using an RF signal for the purpose of tracking a target. In preferred embodiments the information reflects a physiological characteristic of the target, as for example one or more of blood pressure, blood oxygen (PO2), and heart beat. Of particular interest in some embodiments is transmission of a "no heart beat" signal, indicating that the target is likely dead. The heart beat information can also be used to determine when it is likely safe to approach the target, as for example because the target is sufficiently tranquilized.

Figure 8:
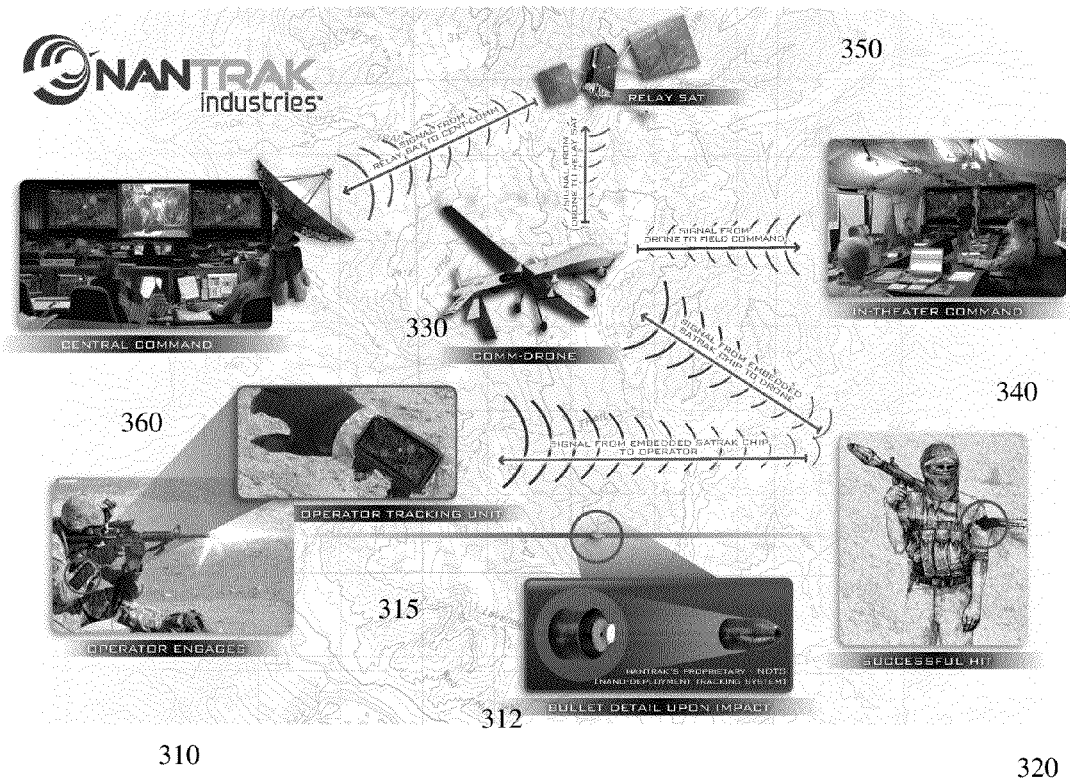
FIG. 8 is a schematic of a system that generally includes a person discharging a projectile from a weapon upon a target where an aerial drone that receives a signal either directly or indirectly from the projectile, a satellite receives a signal from the drone, and distal command receives the signal from the satellite.

FIG. 8 depicts a system 300 that generally includes a person discharging a projectile 312 from weapon 310, a monitor 315 worn or otherwise carried by the person, a target 320 hit by a projectile from the weapon, an aerial drone that receives a signal either directly or indirectly from the projectile 330, an in-theatre command 340, and a satellite 350 that receives a signal from the drone, and distal command 360 that receives the signal from the satellite.

The person in 310 should be interpreted generically, including for example, a hunter, a soldier or other military personnel, undercover agents, police and all manner of security personnel. All suitable ordnance is contemplated, including especially bullets from a gun, but also includes grenades, darts, gas cartridges, and so forth.

The weapon in 310 should be also interpreted generically, as should the ordnance 312. Consequently, all suitable ordnance is contemplated, including especially bullets from a gun, but also includes grenades, darts, gas cartridges, and so forth, and all devices used to shoot these different types of ordnance are considered herein to be weapons whether manned or unmanned, and whether from air, ground or water.

It is contemplated that multiple modules could be deployed at the same time. For example, a single shot from a shotgun could include multiple, signal-generating buckshot. Similarly, a howitzer or mortar could deploy a cluster projectile that splits up into multiple, signal-generating projectiles. Ordnance 312 should be construed broadly to encompass all these possibilities.

Ordnance information can provide any ordnance-relevant, practical information, including for example, one or more of a geographic position, type of ordnance, identity and placement of the shooter, time of discharge, time of deployment, and type of target hit. One or more relays can send the information to any one or more of a local monitor, a local and a distant command. In some embodiments, the tracking module is releasably coupled to a carrier, and a pointed tip is disposed on at least one part of the tracking module and the carrier. In other instances, the tracking module could by coupled to a carrier that has a rounded tip, as for example, in a bullet, cluster bomb, rocket propelled grenade, etc. The module preferably includes a circuit that provides location information to the transmitter, and optionally provides additional information, including at least one of motion, compass, pressure, oxygen, and heart beat information.

Ordnance information can be provided to local or distal recipients. For example, the monitor 315 should be interpreted as whatever device that receives the signal sent by the ordnance, which might or might not be worn or carried by the person discharging the weapon, or delivering the ordnance by throwing, or in some other manner.

In that manner, ordnance 312 is considered to be communicatively coupled with monitor 315, drone 330, local and distal commands 340, 360, and satellite 350. As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Monitor 315 could act as a relay, but ordnance information can additionally or alternatively be received by a dedicated relay. Contemplated relays can range from very simple repeaters all the way to sophisticated processors that determine which information to re-transmit, and when. In some embodiments a relay can utilize data in a repository to supplement or otherwise processes the information received from the ordnance. Relays can be thrown by hand, or launched by a launcher. Relays can have fins or other guiding mechanisms, as for example shown in FIG. 9B. Relays can have an elastic outer surface so they can bounce, and can additionally or alternatively have a sticky outer surface. Relays can be included in a jacket or other item of clothing, or in a pack. Relays can include electronics configured to send a signal to a satellite, or aircraft.

Of course, in many instances relays will be optional. For example, a transmitter carried by an ordnance could generate a sufficiently powerful signal to obviate the need to use a relay.

Computer chips can be included at any suitable stage in transmission, re-transmission, processing and analyzing the ordnance information, and should be construed to be utilized in at least the ordnance 312, the monitor 315, the drone 330, the commands 340, 360, and the satellite 350. This and any other language directed to a computer should be read to include any suitable combination of computing devices, including servers, interfaces, systems, databases, agents, peers, engines, controllers, or other types of computing devices operating individually or collectively, embedded or not. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

In FIG. 8 drone 330 is acting as a type of relay, relaying signals from the ordnance to a local command 340, and ultimately to a distal command 360.

The target 320 should be also be interpreted generically, to include anything struck by the ordnance, whether or not the target is a human, and whether or not that particular impact was intentional.

Deployment in the case of ammunition fired from a gun or launcher is deemed to occur when the ammunition is fired. Deployment of a hand propelled object is deemed to occur when the object becomes operational against a target, as for example when a hand grenade explodes or a gas canister releases a toxic or irritant gas.

Ordnance information can be initiated at discharge, or afterwards, can be delayed for a set time period, or upon existence of a condition, which could include for example, the tracking module resting in a body part, or at some time following impact. "At a time following impact" includes situations where the transmission is initiated before impact, upon impact, or even some time (e.g., seconds, minutes or hours) after impact.

The information sent by the deployed ordnance can be emitted from the ordnance via radio wave, with a transmitter being powered by a battery, or in some other manner. Power could also be derived externally, as for example from an interrogator to a passive or active RFID chip, or chemical energy derived from an interaction with blood of a target. Thus, it is contemplated that signal transmission could be powered by a human body. The type or character of the information sent by the ordnance can change over time, as well as the frequency with which signals are sent, and amplitude or wavelength of the signals.

The transmitter is preferably housed within a module that can be separated from the rest of the ordnance, prior to, upon, or after impact, and FIG. 8 should be construed accordingly.

Figure 9A:
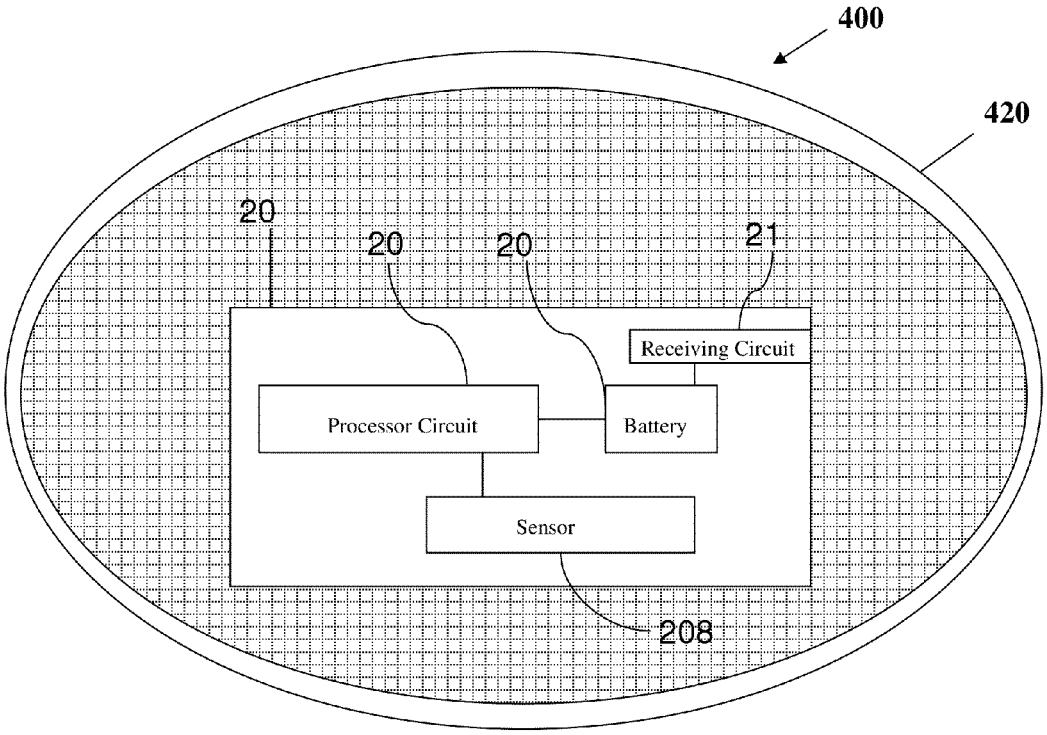
FIGS. 9A and 9B are schematic drawings of embodiments of an egg-shaped relay, within which an exemplary tracking and transmitting system from FIG. 7 is disposed.
Figure 9B:
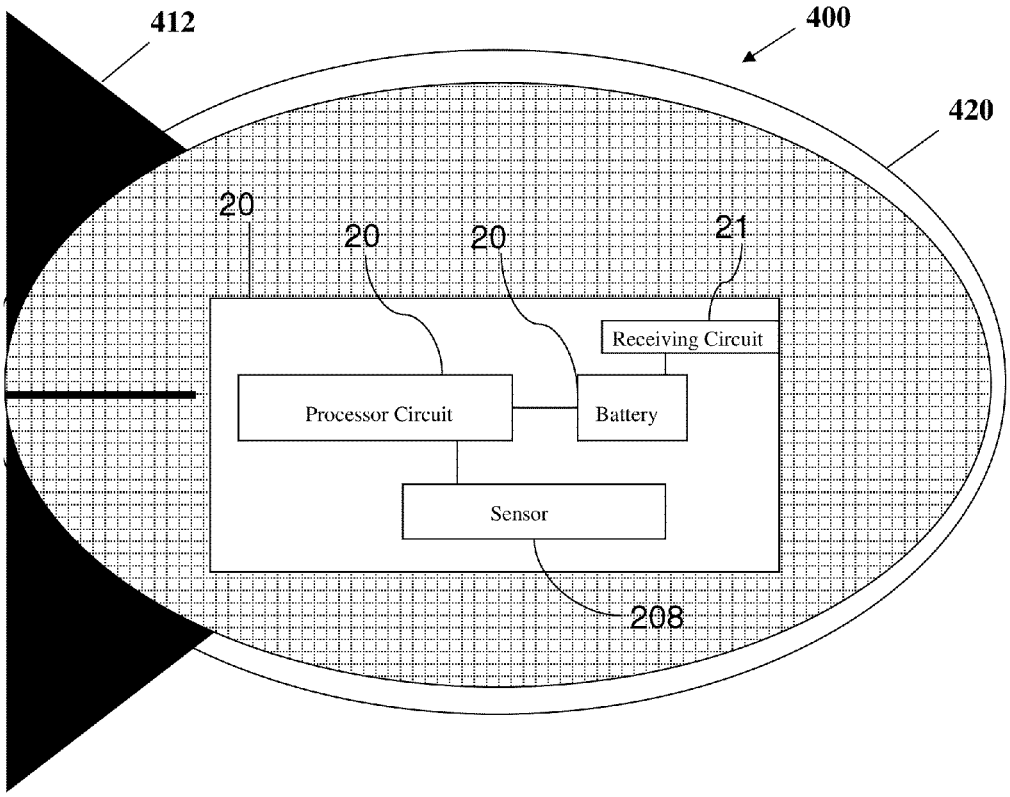

FIG. 9A shows an embodiment of an egg-shaped relay 400, and FIG. 9B shows a similar relay 410 with fins 412. Either or those, as well as another suitable shape can have special coatings 420, including for example a rubber or other coating that facilitates bouncing, or a sticky coating that facilitates adherence.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps can be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A pneumatically propelled ordnance, comprising:
an explosive propulsion charge in the ordnance;
a position module configured to identify a geographic position;
a sensor configured to sense a condition; and
a tracking module configured to electronically transmit information regarding the geographic position beginning at a time following satisfaction of the condition.

2. The ordnance of claim 1, wherein the condition comprises the tracking module resting in a body part and a defined time delay.

3. The ordnance of claim 1, wherein the condition comprises the ordnance being discharged from a gun.

4. The ordnance of claim 1, wherein the condition comprises the ordnance being discharged from a launcher.

5. The ordnance of claim 1, wherein the condition comprises the ordnance being discharged from an aircraft.

6. The ordnance of claim 1, wherein transmission of the information is powered at least in part by chemical energy derived from an interaction with the target.

7. The ordnance of claim 1, wherein the tracking module is configured to seek for and connect with a local area network.

8. The ordnance of claim 1, wherein the pneumatically propelled ordnance comprises a rocket propelled grenade.

9. The ordnance of claim 1, wherein the pneumatically propelled ordnance comprises a bullet.

10. The ordnance of claim 1, wherein the pneumatically propelled ordnance comprises frangible ammunition.

11. The ordnance of claim 1, wherein the pneumatically propelled ordnance comprises a color marker.

12. A munition comprising:

a sensor configured to sense a condition; and a tracking module configured to initiate transmission of a first type of information at a first time $T_1$ following the sensed condition at $T_0$, and a second type of information at a subsequent second time $T_2$ following $T_1$, wherein the first type of information is different from the second type of information.

13. The ordnance of claim 12, wherein $T_1$ is within 1 second of $T_0$.

14. The ordnance of claim 13, wherein $T_2$ is at least five seconds after $T_0$.

15. The ordnance of claim 12, wherein the first type of information provides data that can be used to identify at least one of (a) a person responsible for firing the munition and (b) a type of ordnance fired.

16. The ordnance of claim 12, wherein the first type of information provides data that can be used to identify a geographic position of the munition.

* * * * *